US011285535B2

(12) United States Patent
Sterkenburg

(10) Patent No.: US 11,285,535 B2
(45) Date of Patent: Mar. 29, 2022

(54) PRESS-TOOL

(71) Applicant: SECO TOOLS AB, Fagersta (SE)

(72) Inventor: Dirk Sterkenburg, Gustafs (SE)

(73) Assignee: SECO TOOLS AB, Fagersta (SE)

( * ) Notice: Subject to any disclaimer, the term of this patent is extended or adjusted under 35 U.S.C. 154(b) by 749 days.

(21) Appl. No.: 16/311,479

(22) PCT Filed: Jun. 29, 2017

(86) PCT No.: PCT/EP2017/066232

§ 371 (c)(1),
(2) Date: Dec. 19, 2018

(87) PCT Pub. No.: WO2018/002282

PCT Pub. Date: Jan. 4, 2018

(65) Prior Publication Data

US 2019/0240731 A1 Aug. 8, 2019

(30) Foreign Application Priority Data

Jun. 30, 2016 (EP) ..... 16177300

(51) Int. Cl.

| | |
|---|---|
| ***B22F 3/03*** | (2006.01) |
| ***B30B 11/00*** | (2006.01) |
| ***B30B 15/02*** | (2006.01) |

(52) U.S. Cl.

CPC ..... *B22F 3/03* (2013.01); *B30B 11/007* (2013.01); *B30B 15/022* (2013.01); *B22F 2003/033* (2013.01); *B22F 2301/15* (2013.01); *B22F 2302/10* (2013.01); *B22F 2999/00* (2013.01)

(58) Field of Classification Search

CPC ..... B22F 3/03; B22F 2003/031; B22F 2003/033; B30B 11/007; B30B 15/022; B29C 2043/5007; B29C 2043/5023; B29C 2043/3665

See application file for complete search history.

(56) References Cited

U.S. PATENT DOCUMENTS 3,720,491 A * 3/1973 Dedek ..... B30B 11/027 425/78
4,408,807 A * 10/1983 Singer ..... B29C 33/0033 384/475

(Continued)

FOREIGN PATENT DOCUMENTS

EP 2808106 A1 12/2014
GB 121239 A * 12/1918 ..... B29C 33/12

(Continued)

*Primary Examiner* — Timothy Kennedy
(74) *Attorney, Agent, or Firm* — Corinne R. Gorski

(57) ABSTRACT

A press-tool for manufacturing a cutting insert green body includes a first and a second punch movable along a first pressing axis. A first and a second die member are movable towards an end position. The first and the second die members are configured to form, in the end position, a die cavity. A core extends between and through the die cavity when the first and the second die member are in the end position. At least a first core portion is arranged to form the core, wherein the at least first core portion is arranged in the first or the second die member such that the at least first core portion is moved together with the first or the second die member.

17 Claims, 10 Drawing Sheets

(56) References Cited

U.S. PATENT DOCUMENTS

| | | | | | |
|---|---|---|---|---|---|
| 5,378,416 | A * | 1/1995 | Kishi | B22F 5/08 | 264/109 |
| 6,101,713 | A * | 8/2000 | May | B22F 3/03 | 29/445 |
| 6,113,378 | A * | 9/2000 | Tsuboi | B30B 11/04 | 425/352 |
| 8,033,805 | B2 | 10/2011 | Gubanich et al. | | |
| 2004/0086415 | A1* | 5/2004 | Gubanich | B22F 3/03 | 419/38 |
| 2008/0298996 | A1* | 12/2008 | Kuplen | B22F 3/03 | 419/66 |
| 2009/0136776 | A1 | 5/2009 | Gubanich et al. | | |
| 2009/0169412 | A1* | 7/2009 | Samuelsson | B22F 3/03 | 419/68 |
| 2009/0263527 | A1* | 10/2009 | Smilovici | B23C 5/207 | 425/78 |
| 2013/0039798 | A1* | 2/2013 | Satran | B22F 5/10 | 419/38 |
| 2014/0086695 | A1 | 3/2014 | Jameson et al. | | |
| 2017/0246687 | A1* | 8/2017 | Schwarz | B30B 15/0082 | |

FOREIGN PATENT DOCUMENTS

| | | | | | |
|---|---|---|---|---|---|
| GB | 2012654 | A | * | 8/1979 | B30B 15/022 |
| JP | H10118796 | A | | 5/1998 | |
| JP | 11300497 | A | * | 11/1999 | B22F 5/10 |
| JP | 2000071099 | A | * | 3/2000 | B30B 15/304 |
| JP | 2002307199 | A | * | 10/2002 | B30B 11/007 |
| WO | 2013024473 | A9 | | 2/2013 | |

* cited by examiner

PRESS-TOOL

RELATED APPLICATION DATA

This application is a § 371 National Stage Application of PCT International Application No. PCT/EP2017/066232 filed Jun. 29, 2017 claiming priority to EP 16177300.7 filed Jun. 30, 2016.

TECHNICAL FIELD

The present disclosure relates to a press-tool for manufacturing a cutting insert green body.

BACKGROUND ART

Cutting inserts are metal cutting tools for machining of metal by milling, drilling or turning or by similar chip forming methods. Cutting inserts are produced by powder metallurgical methods from a metallic powder, for example, a mixture comprising tungsten carbide and cobalt, such as a cemented carbide powder, or from a ceramic powder, for example a mixture comprising aluminum oxide, silicon nitride and silicon carbide. Cutting inserts may also be manufactured from cermets, for example, from a mixture comprising titanium carbide and nickel, or other materials such as, for example, cBN materials. The powder is compacted into a cutting insert green body by opposing first and second punches in a die cavity. After compaction, the cutting insert green body is removed from the die cavity and sintered into a solid cutting insert.

Typically, cutting inserts are provided with a through-hole by which the cutting insert may be attached to a tool holder by means of a screw or pin.

In manufacturing of certain types of cutting inserts, so called "tangential inserts" or "cross-hole inserts" the through-hole may be formed by two cores which are inserted into the die cavity in a direction which is non-parallel to the main pressing direction.

A problem related to the manufacturing of cross-hole inserts is that the non-parallel arrangement of the cores in relation to the main pressing direction causes the density distribution in the cutting insert green body to be uneven. Generally, the density of the compacted powder is highest where the distance between the punches and the cores is small, i.e. the density is relatively high in the end portions of the cutting insert and relatively low in the central area of the cutting insert green body. When the cutting insert green body shrinks during sintering, the uneven density distribution causes the cutting insert green body to deform into an undesirable shape. Described in simple terms, from a side view, the rectangular shape deforms into the undesired time-glass shape as shown in FIG. 11. To provide an acceptable end product it is therefore often necessary to grind the cutting insert to final dimensions.

One method of reducing the need for costly post-machining of cutting inserts is to use so called "tool compensation". According to this method, the die cavity used for manufacturing the cutting insert green body is designed such that, described in simple terms, from a side view, a barrel shaped cutting insert green body is formed, see FIG. 12. During sintering the shrinkage of such a green body results into a wanted rectangular, near net shape cutting insert. From other (orthographic) view directions, the green body may have additional concave, convex or other complex shapes for the purpose to achieve a final near net shape after sintering.

However, a barrel shaped cutting insert green body, i.e. in which the central area is wider than the end portions, cannot be manufactured in a press-tool having a non-splitable die cavity. This, since it is not possible to eject the compacted cutting insert green body by pushing it out of the non-splitable die cavity with the lower punch without damaging the cutting insert green body.

EP2808106 shows a press-tool for pressing cutting insert green bodies having a non-splitable die cavity. However, while the press-tool is useful for producing conventional cutting insert green bodies, it is not suitable for manufacturing barrel shaped cutting insert green bodies, since it has a die cavity that cannot be split.

US2009/0263527 shows a press-tool for pressing cutting insert green bodies having basically a barrel shape. The die parts are movable upwards/downwards in direction parallel with the pressing axis of the punches while the cores are moved in direction non-parallel with the pressing axis. The overall construction of US2009/0263527 is therefore complicated.

U.S. Pat. No. 8,033,805 shows a press-tool which comprises die parts that are movable in direction non-parallel to the pressing axis and movable cores. However, since both die parts and cores needs to be displaced independently along the same axis also the configuration of this press-tool is complicated.

Thus, it is an object of the present discloser to provide a press-tool for manufacturing a cutting insert green body which solves or at least mitigates one problem of the prior art. In particular, it is an object of the present disclosure to provide a press-tool which is of simple and robust design. Moreover it is an object of the present disclosure to provide a press-tool which allows for fast and reliable manufacturing of cutting inserts having a through-hole.

SUMMARY OF THE INVENTION

According to the present disclosure at least one of these objects is met by a press-tool 1 for manufacturing a cutting insert green body 2, comprising:

- a first and a second punch 8, 9 arranged movable towards and away from each other along a first pressing axis (A);
- a first and a second die member 100, 200 arranged movable towards and away from an end position along at least a second axis (B) which is non-parallel to the first pressing axis (A), wherein
- the first die member 100 comprises a first die cavity surface 103 and the second die member 200 comprises a second die cavity surface 203, and the die members 100, 200 are configured to form, in the end position, a die cavity 3 having first and second openings 4, 5 for receiving the first and second punches 8, 9, and;
- a core 6 extending between the first and the second die cavity surface 103, 203, through the die cavity 3, when the first and the second die members 100, 200 are in the end position, and;
- at least a first core portion 40, 50 for forming at least a portion of the core 6, characterized in that the at least first core portion 40, 50 is arranged in the first or the second die member 100, 200 and joined to the first or the second die member 100, 200, such that the at least first core portion 40, 50 is moved together with the first or the second die member 100, 200 to the end position.

In the press-tool according to the present disclosure, the core for achieving a through-hole in the cutting insert green body is formed by at least one core portion which is integrated in at least one of the die members. Since the core portion follows the movement of the die member during the different steps of the pressing cycle the need for auxiliary drives for moving the core portion in relation to the die member is omitted. Therefore, in the press-tool according to the present disclosure, the need for drives for moving press-tool parts in direction non-parallel to the main pressing axis is reduced and essentially limited to drives for moving the die members. Overall, this results in a low complex press-tool which may be designed, manufactured, maintained and used in production at relatively low cost.

According to a first embodiment, the press-tool 1 comprises a first core portion 40 which is arranged in, and joined to, the first die member 100 and a second core portion 50 which is arranged in, and joined to, the second die member 200, such that the first core portion 40 is moved together with the first die member 100 to the end position and the second core portion 50 is moved together with the second die member 200 to the end position and form a core 6 through the die cavity 3.

According to a second embodiment, the press-tool 1 comprises one single core portion 40, 50 which is arranged in one of the first and the second die members 100, 200 and joined to said one of the first and the second die members 100, 200, such that the one single core portion 40, 50 is moved together with said one of the first and second die members 100, 200 and forms a core 6 which extends from one of the first and the second die cavity surfaces 103, 203, through the die cavity 3, to the other of the first and the second die cavity surfaces 103, 203.

Further alternatives and advantages of the press-tool according to the present disclosure are disclosed in the appended claims and in the following detailed description.

DEFINITIONS

In the present disclosure reference is sometimes made to directions such as "upper" and "lower" or "vertical" and "horizontal". It is appreciated these references are to be interpreted with regards to the ground surface. That is, horizontal direction is parallel with the ground surface and vertical direction is perpendicular to the ground surface.

By the expression that the at least first core portion is "joined to the first or the second die member 100, 200" is meant that the at least first core portion is attached to or formed integral with or in any other way are integrated in the first or second die member such that the at least first core portion follow the movement of the first or the second die member.

DETAILED DESCRIPTION OF EMBODIMENTS

The press-tool according to the present disclosure will hereinafter be described more fully. The press-tool according to the present disclosure may however be embodied in many different forms and should not be construed as limited to the embodiments set forth herein. Rather, these embodiments are provided by way of example so that this disclosure will be thorough and complete, and will fully convey the scope of the present disclosure to those persons skilled in the art. Same reference numbers refer to same elements throughout the description.

Figure 1A:
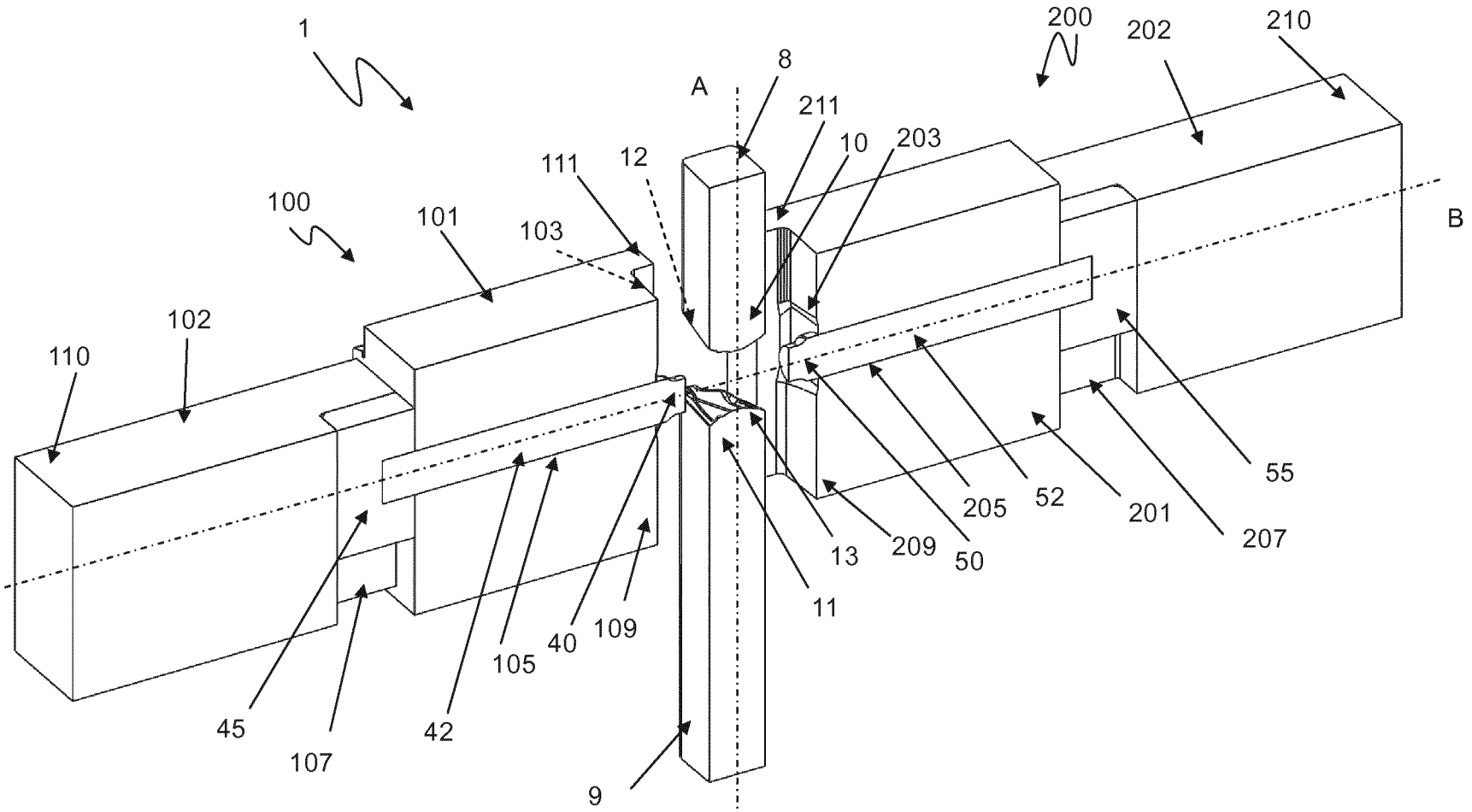
FIG. 1*a*: A schematic drawing of a press-tool according to a first exemplary embodiment of the disclosure in cross-section.

FIG. 1*a* shows a partially exploded view of a press-tool 1 according to a first embodiment of the present disclosure. The press-tool 1 is configured to press powder, such as metal powder or ceramic powder or blends thereof, into a cutting insert green body. The press-tool 1 comprises a first, upper, punch 8 and a second, lower, punch 9 which are movable towards each other along a first pressing axis A. The press-tool 1 further comprises a first die member 100 and a second die member 200 which are movable towards and away from each other along a second axis B. The set of first and second punches 8, 9 and the set of first and second die members 100, 200 are arranged such that the first pressing axis A and the second axis B are in non-parallel orientation with regards to each other. Thus, the press-tool 1 shown in FIG. 1*a* is a vertical press-tool and therefore the first pressing axis A is a vertical axis. The second axis B is a horizontal axis and is thus oriented perpendicular to the first pressing axis A. The press-tool 1 shown in FIG. 1*a* is intended to be utilized in a multi-axial press machine.

In the embodiment shown in FIG. 1*a*, the first and the second die members 100, 200 respectively comprise a die part 101, 201 and an attachment block 102, 202 by which various components of a press-machine (not shown) may be attached to the press-tool 1. For example, drive units for moving the die members 100, 200. In FIG. 1*a-d* the attachment blocks 102, 202 and the die parts 101, 201 are discrete components which are joined together by e.g. a bolted joint. However, it is also possible to design the die members 100, 200 into integral units. In that case each die member 100, 200 is constituted by one singe elongate die part 101, 201.

Movement of the die members 100, 200 may be achieved by an electrical drive, such as an electrical motor, connected via a ball-screw mechanism (not shown) to a respective end portion 110, 210 of the first and second die members 100, 200. It is also possible to use other types of linear actuators, such as hydraulic cylinders (not shown) to move the first and the second die members 100, 200 towards and away from each other.

Movement of the first and the second punches 8, 9 may also be achieved by electrical drives or by hydraulic cylinders as described above.

The first and the second die members 100, 200 comprise, respectively, a die cavity surface 103, 203 which is formed in opposing front ends 109, 209 of the die members 100, 200. The front ends 109, 209 of the die members 100, 200 may further comprise a respective die contact surface 111, 211.

The first and second punches 8, 9 also comprise a respective forming surface 12, 13 which is formed in the opposing front ends 10, 11 of the first and the second punches 8, 9.

In FIG. 1*a*, only the forming surface 13 of the second punch 9 and the die cavity surface 203 of the second die member 200 are visible due to the perspective of the drawing. However, the position of the forming surface 12 of the first punch 8 and the die cavity surface 103 of the first die member 100 are indicated by dashed arrows and correspond to the positions of the die cavity surface 203 of the second die member and the forming surface 13 of the second punch 9.

According to one embodiment of the disclosure, the press-tool 1 comprises a first core portion 40 which is arranged in the first die member 100 and a second core portion 50 which is arranged in the second die member 200. The first core portion 40 extends, i.e. protrudes, from the die cavity surface 103 of the first die member 100 and the second core portion 50 extends, i.e. protrudes from the die cavity surface 203 of the second die member 200. In the embodiment shown in FIG. 1*a*, the first and the second core portions 40, 50 extend, respectively, from the die cavity surfaces 103, 203 in direction parallel to the second axis B. However, the core portions 40, 50 could also have other orientations.

The die cavity surfaces 103, 203 of the first and the second die members 100, 200 and the forming surfaces 12, 13 of the first and the second punches 8, 9 are designed to impart, together with the core portions 40, 50, the desired geometrical form and surface configuration of a cutting insert green body manufactured in the press-tool 1.

Figure 1B:
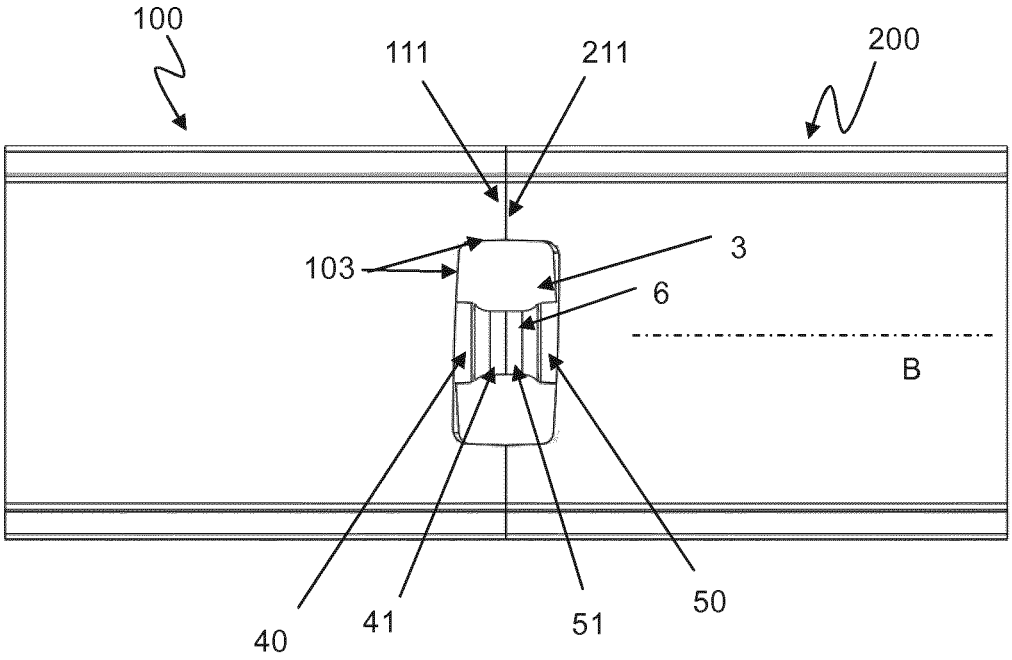
FIG. 1*b-d*: Schematic drawings of details of the press-tool of the first embodiment.
Figure 1C:
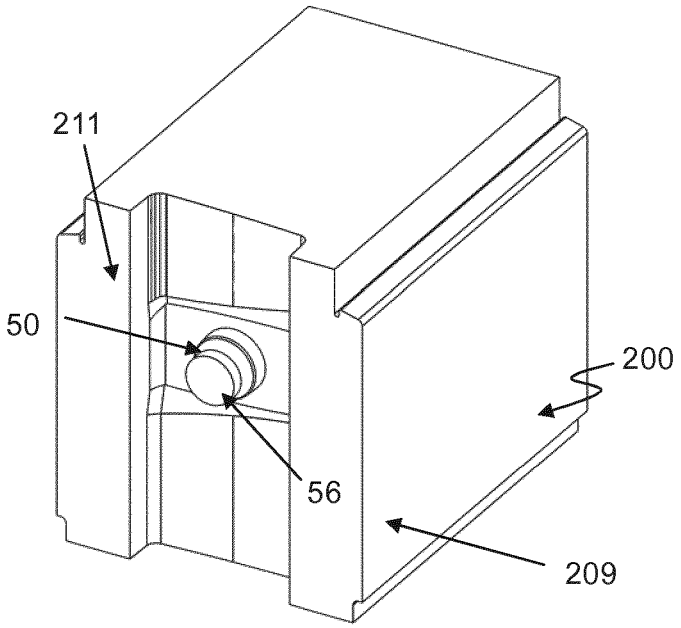

Turning to FIG. 1*b*. In operation, the first and the second die members 100, 200 are moved towards each other along the axis B to an end position in which a die cavity 3 is formed between the first and the second die cavity surfaces 103, 203. FIG. 1*b* shows a view from above of a portion of the press-tool 1 with the die members 100, 200 in the end position. In the embodiment shown in FIG. 1*b*, the die contact surfaces 111, 211 of the first and second die members 100, 200 are in abutment with each other. However, it is appreciated that when the die members 100, 200 are in the end position, there may also be a small gap, i.e. a play (not shown) between the die contact surfaces 111, 211 in order to avoid wear on the die members 100, 200. The first and the second core portions 40, 50 extend into the die cavity and form a core 6 through the die cavity 3. Thus, the first core portion 40, forms a first portion of the core 6 and the second core portion 50 forms a second portion of the core 6. The core 6 will result in a through-hole, e.g., a cross-hole, in the cutting insert. To mutually engage each other, the respective front portion 41, 51 of the core portions 40, 50 shown in the embodiment of FIG. 1*a, b* may be provided with a contact surface 46, 56 which is configured to come into abutment with the contact surface of the other core portion (contact surface 56 is shown in FIG. 1*c*). It is however appreciated that under certain circumstances, for example, due to wear, or intentionally to avoid wear, of the core portions 40, 50, there may be a small play between the contact surfaces 46, 56 of the core portions 40, 50. However, preferably, the first and the second core portions 40, 50 are in engagement with each other and form a continuous core 6 through the die cavity 3.

For example, the contact surfaces 46, 56 are flat surfaces. It is appreciated that the length, i.e. the axial extension, of each core portion 40, 50 is selected such that the core portions 40, 50 come into engagement in the die cavity. In FIG. 1*b*, the first and second core portions 40, 50 are of equal length and engage each other in the center of the die cavity. However, it is also possible to design the core portions 40, 50 with different axial extensions such that one core portion is longer than the other core portion (not shown). An advantage thereof is the possibility to control the position the axial position of a flash, i.e. the press burr that may be formed in the cross-hole of the cutting insert green body where the core portions 40, 50 engage.

FIG. 1*c*, shows a perspective view of the front end 209 of the second die member 200 including the core portion 50 and the contact surface 56. FIG. 1*c* also shows the configuration of the die contact surface 211 of the second die member 200 which in this embodiment are plane surfaces, i.e. of straight profile. However, it is possible that the die contact surface 211 is of other configuration (not shown), for example, non-flat. The configuration of the die contact surfaces 111, 211 is selected in dependency of the geometry of the cutting insert green body. This is so, since the split line between the first and the second die members needs to be in a position which allows the die members to move away (in direction of axis B) from the cutting insert green body and open the die cavity 3 without damaging the cutting insert green body. It is appreciated that the die contact surface 111 of the first die member 100 (not shown) is configured correspondingly to the die contact surface 211 of the second die member 200.

Other configurations of the first and the second core portion 40, 50 are also possible as will be explained at the end of the description.

Further, according to one exemplary embodiment of the present disclosure, the first and the second core portions 40, 50 are joined to the respective first and second die members 100, 200 such that the first and the second core portions 40, 50 are moved together with the first and the second die members along the axis B towards and away from the end position. Preferably, the core portions 40, 50 are thereby releasable attached to the first and the second die members 100, 200 as will be described hereinafter. Releasable attachment is advantageous since, the core portions 40, 50 are subjected to wear and need to be replaced from time to time. The core portions 40, 50 are expected to be replaced more often than the die parts 101, 201.

Returning to FIG. 1*a*, the first die member 100 comprises a bore 105 which extends from the die cavity surface 103 towards the rear end portion 110 of the first die member 100. Accordingly, the second die member 200 comprises a bore 205 which extends from the die cavity surface 203 towards the rear end portion 210 of the second die member 200. In the described embodiment, the bores 105, 205 extend from the die cavity surface 103, 203 through the die parts 101, 201 to the attachment blocks 102, 202 of the respective die members 100, 200. However, the bores may be of any length. For example the bore may be a through-hole from die cavity surface to the rear end of each die member 100, 200. The bore may also be a blind hole in the die members 100, 200.

The first core portion 40 comprises a pin 42 which extends in a direction away from the front portion 41 of the first core portion 40. The second core portion 50 comprises a pin 52 which extends in a direction away from the front portion 51 of the second core portion 50. Front portions 41, 51 are indicated in FIG. 1*b*. The first and the second core portions 40, 50 and their respective pins 41, 51 may thereby be integral, i.e. formed in one piece or two separate pieces that have been joined by e.g. soldering.

The pins 42, 52 of the core portions 40, 50 are arranged, i.e. inserted, in the respective bores 105, 205 in the first and the second die members 100, 200 such that the pin extends in the bore 105, 205 towards the rear end 110, 210 of the respective die members 100, 200 and such that the core portions 40, 50 extend from the respective die cavity surface 103, 203.

In the described embodiment, the first and the second core portions 40, 50 are releasably attached to the respective first and second die members 100, 200 by mechanically joining of the first and the second core portions 40, 50 to the respective first and second die members 100, 200. Mechanical joining may be achieved by form-fitting of the first and the second core portions 40, 50 in the respective first and second die members 100, 200. In the embodiment shown in FIG. 1*a*, the first and the second pins 42, 52 are attached to a respective locking member 45, 55 which is received in a form-fitting engagement in a respective recess 107, 207 in the first and the second die members 100, 200.

Figure 1D:
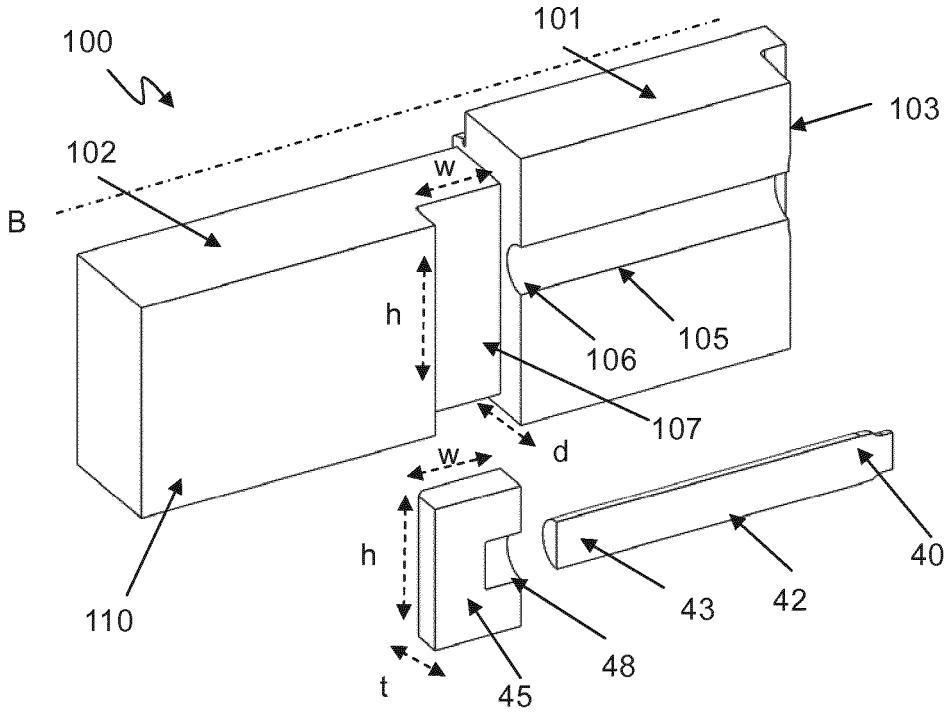

FIG. 1*d* shows an exploded view of the first die member 100. It is appreciated that the features shown in FIG. 1*d* and the description below also are valid for the second die member 200.

As descried above, the first die member 100 comprises a bore 105 which extends through the first die member 100 from the die cavity surface 103 towards the end 110 of the first die member 100. The first die member 100 further comprises a recess 107 which is arranged at the end 106 of the bore 105. In the described embodiment, the recess 107 is arranged in the first attachment block 102, adjacent to the first die part 101. However, the recess 107 may alternatively be arranged in the first die part 101 or at the end 110 of the first die member 100. The recess 107 and its function may also be achieved by combining two matching recess of which one is arranged in the first attachment block 102 and the other in the first die part 101 (not shown).

The pin 42 of the first core portion 40 comprises a locking member 45 which is configured to be received in the recess 107 in the first die member 100 (as shown in FIG. 1*a*). The locking member 45 may be arranged at the end 43 of the pin 42 of the core portion 40. Typically, the locking member 45 and the recess 107 have corresponding shape and dimensions such that the locking member 45 may be received and held in a fixed manner in the recess 107 to restrict or prevent rotational and/or translational movement of the core portion 40 Therefore, in the embodiment shown in FIGS. 1*a* and 1*d*, the recess 107 and the locking member 45 are of rectangular shape wherein the width (w), seen in direction of the axis B, of the recess 107 and the locking member 45 are of the same or at least corresponding dimension. The height (h) of the recess 107 may be greater than the height (h) of the locking member 45 (as shown in FIG. 1*d*). However, the height (h) of the locking member 45 and the recess 107 may also be the same, which results in a tight form fit between the locking member 45 and the recess 107. Also the depth (d) of the recess 107 and the thickness (t) of the locking member 107 are of corresponding, or same, dimensions to restrict rotational and/or translational movement of the core portion 40.

The pin 42 of the first core portion 40 may be attached to the locking member 45 by inserting the end 43 of the pin 42 in a bore 48 in the locking member 45 and adhesively attach the end 43 of the pin 42 to the locking member 45. Adhesive attachment may be achieved by, for example, gluing or soldering. It is also possible to form the pin in one piece with the locking member by, for example, machining the pin out of a solid block of metal.

The locking function may also be achieved by other locking principles, for example, by using a dowel-pin coupling. According to one alternative (not shown) a cylindrical dowel-pin is inserted with a tight fit in a cylindrical hole that extends through both the first die member 100 and the pin 42 of the core portion 40, preferably in a direction perpendicular to axis B, thereby restricting or preventing rotational and/or translational movement. The cylindrical dowel-pin has a diameter that corresponds to the cylindrical hole to prevent play.

Other examples of pin configurations and other methods of joining the core portions to the die members will be described at the end of the description.

Figure 2:
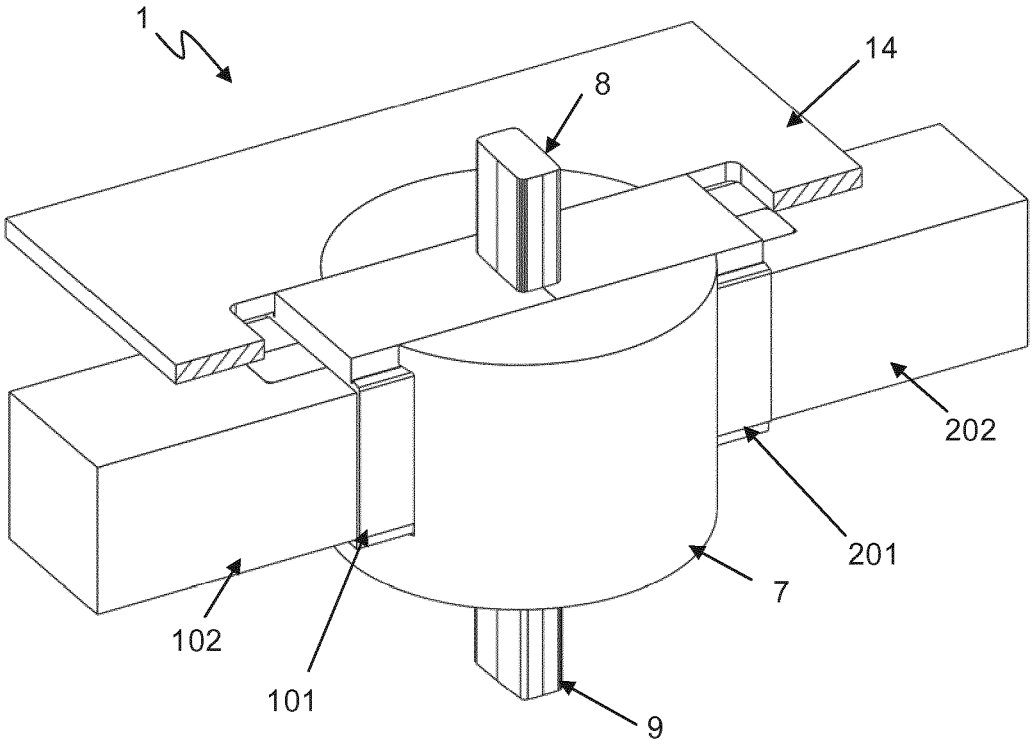
FIG. 2: A schematic full view drawing of the press-tool according to the first embodiment of the present disclosure.

It is appreciated that the press-tool 1 described in FIG. 1*a* is shown in a longitudinal cross sectional view and that some components have been removed to make other components visible. For completeness, FIG. 2 shows a perspective full view of the press-tool 1. Thus the press-tool 1 comprises, in addition to components described above, a die member holder 7 which encloses the first and the second die parts 101, 201 and a die/fill table 14. Also visible in FIG. 2 are the first and second punches 8, 9 and the attachment blocks 102, 202 of the first and second die members 100, 200.

It is further appreciated that the press-tool 1 may comprise further die members (not shown), such as a third and a fourth die member which are movable towards and away from an end position along a third axis. The third and the fourth die members may, or may not, comprise core portions. The press-tool may also comprise more than a first and a second core portion. For example, the first die member may comprise a first and a second core portion and the second die member may comprise a third and a fourth core portion. It is also possible that the press-tool comprises further punches, such as a third and a fourth punch.

The press-tool 1 according to the present disclosure will in the following be described with reference to FIGS. 3*a*-3*e* which shows steps of a pressing cycle.

Figure 3A:
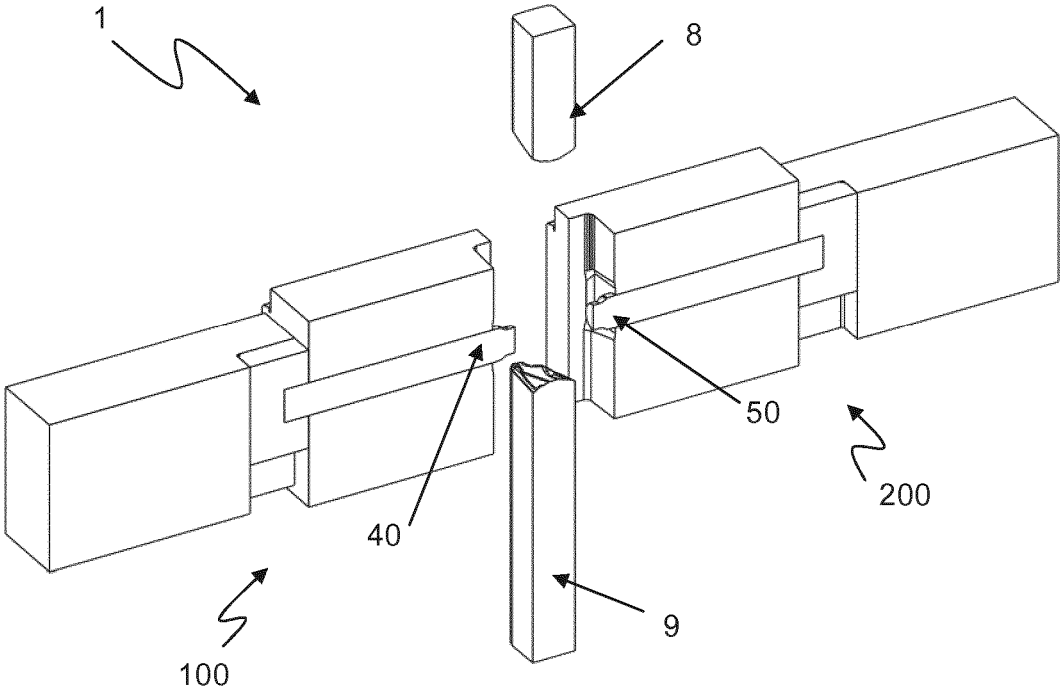
FIGS. 3*a-e*: Schematic cross-sectional drawings of the press-tool according the first embodiment of the present disclosure in various steps of a pressing cycle.

FIG. 3*a* shows the press-tool 1 in an initial position in which the first and the second die members 100, 200 have been moved away from the end position. The core portions 40, 50 extend from the die cavity surfaces 103, 203 of the respective first and second die members 100, 200. The first, upper, punch 8 is raised above the first and the second die members 100, 200 and the second, lower, punch 9 is in a position between the front end portions 109, 209 of the first and the second die members 100, 200.

Figure 3B:
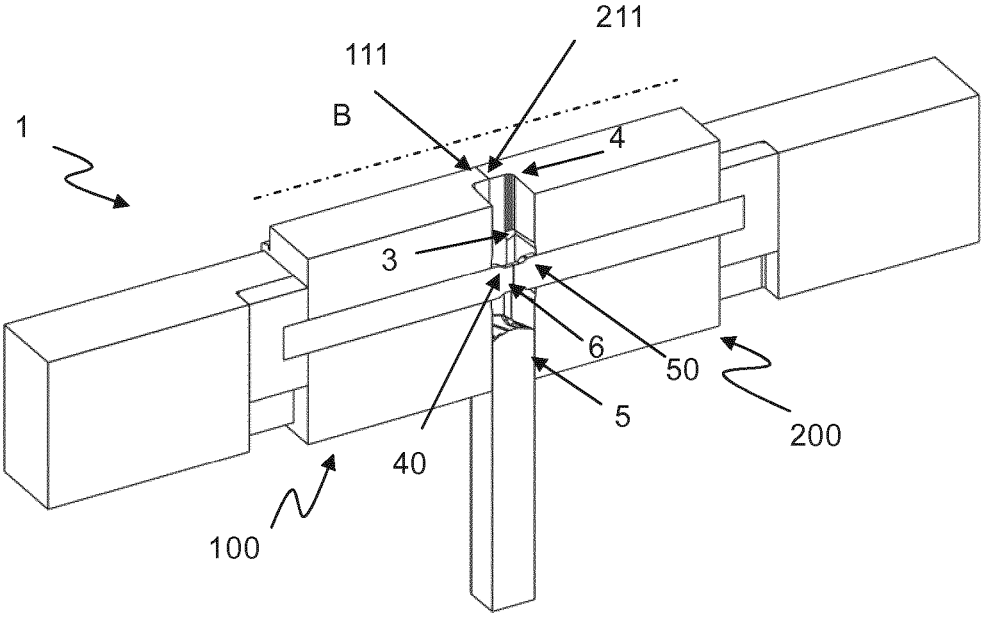

FIG. 3*b* shows the press-tool 1 when the first and the second die members 100, 200 have been moved in direction towards each other along the axis B, to the end position. The die contact surfaces 111, 211 of the first and the second die members 100, 200 are in contact with each other and a die cavity 3 is formed between the die cavity surfaces 103, 203 of the first and the second die members 100, 200. The first and the second core portions 40, 50, which are joined to the first and the second die members 100, 200, have been moved together with the first and the second die members 100, 200 and now extend into the die cavity 3 and form a core 6 through the die cavity 3. In the end position of the die members 100, 200, the die cavity 3 comprises a first, upper, opening 4 for receiving the first, upper, punch 8 and a second, lower, opening 5 for receiving the second, lower, punch 9. In this position, powder is introduced into the die cavity by for example a fill shoe (not shown).

Figure 3C:
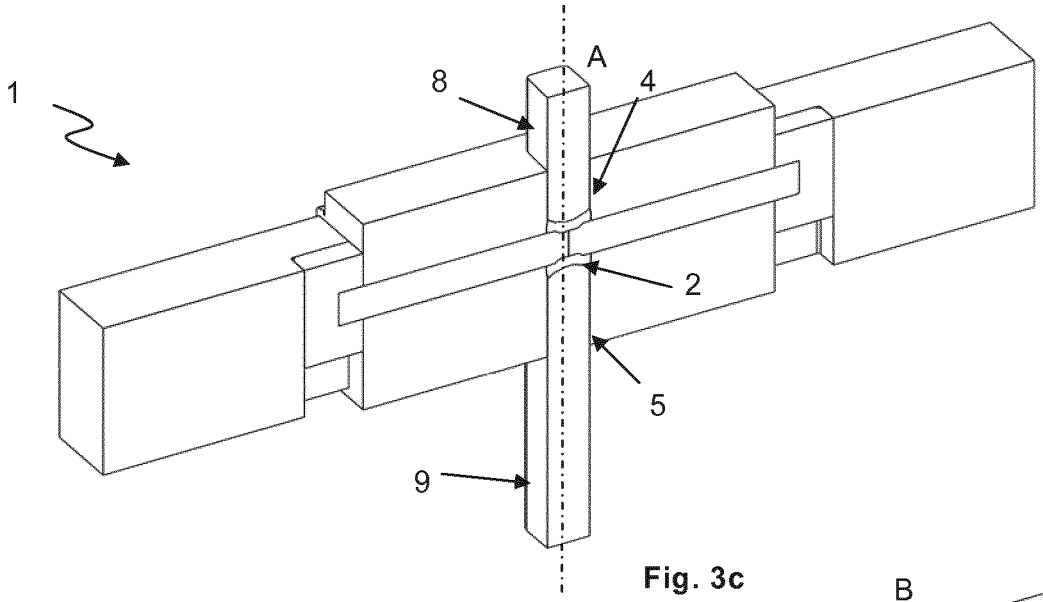

In FIG. 3*c*, the first, upper, punch 8 has been received in the first opening 4 of the die cavity 3 and the first and second punches 8, 9 are moved towards each other along the first pressing axis A and compact the powder in the die cavity into a cutting insert green body 2.

Figure 3D:
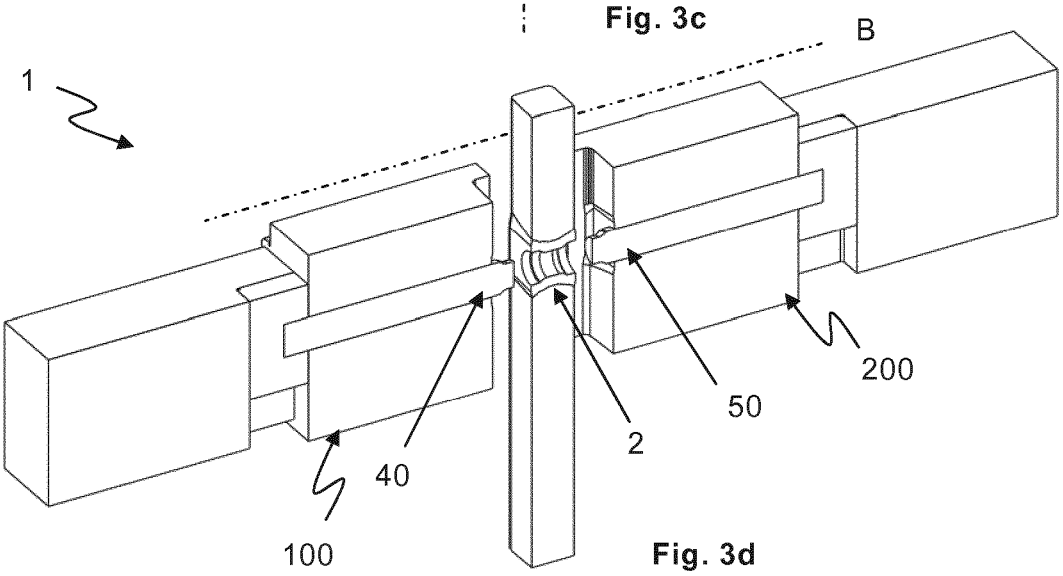

In FIG. 3*d*, the die cavity 3 is opened by moving the first and the second die members 100, 200 away from each other along the second axis B from the end position. The first and the second core portions 40, 50 are thereby moved together with the first and the second die member 100, 200 and are retracted from the through-hole in the cutting insert green body.

Figure 3E:
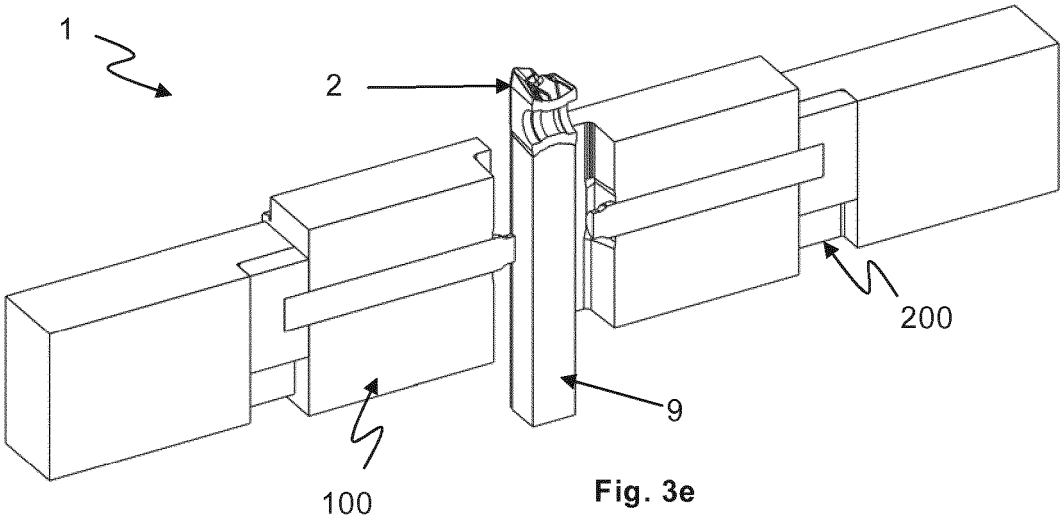

In FIG. 3*e*, the cutting insert green body is ejected from the press-tool 1 by moving the first, upper, punch 8 (not shown) and the second, lower, punch 9 upwards. Thereafter the first, upper, punch 8 (not shown) is raised further to allow the cutting insert green body 2 to be collected.

In the following various alternatives of the press-tool 1 of the first embodiment shown in FIGS. 1*a*-1*d* will be described. In the description of these alternatives, only features that differ from the first embodiment are shown and described in detail. However, it is appreciated that these alternatives also comprise appropriate features of the first embodiment and are fully compatible therewith.

Figure 4:
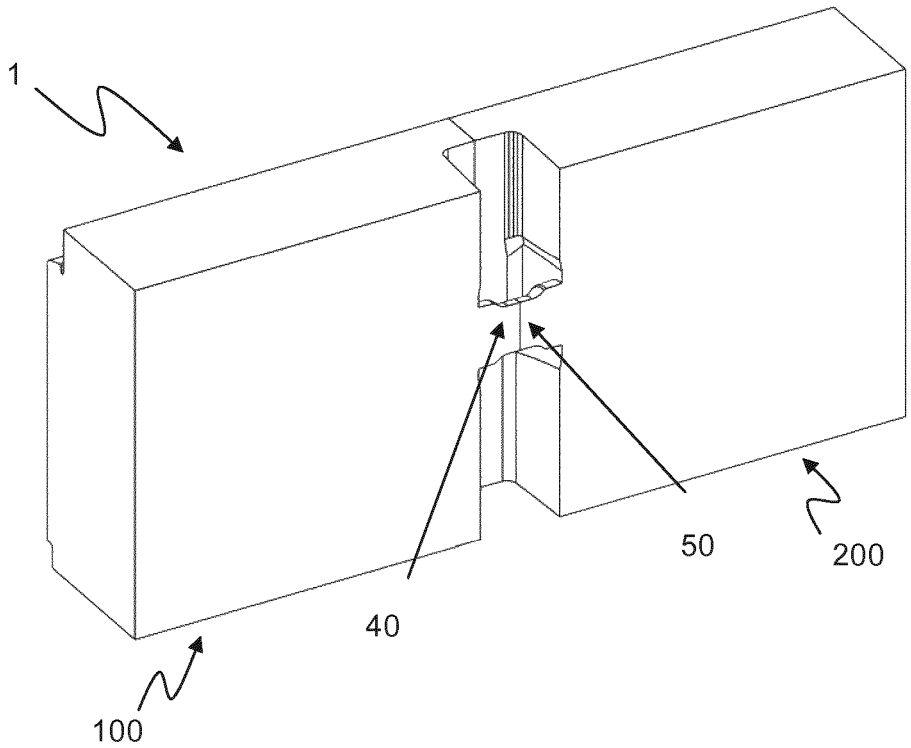
FIGS. 4-9: Schematic cross-sectional drawings of alterative configurations of a press-tool according to the present disclosure.

FIG. 4 shows an alternative of the press-tool 1 in which the first and the second core portions 40, 50 are integral with the respective first and second die members 100, 200. The core portions 40, 50 and the respective first and the second die members 100, 200 thereby each form one single piece in which the core portions 40, 50 are permanently joined with the respective die members 100, 200. For example, the first and the second core portions 40, 50 and the die members 100, 200 may respectively be formed from one single piece of metal by e.g. spark erosion or milling.

Figure 5:
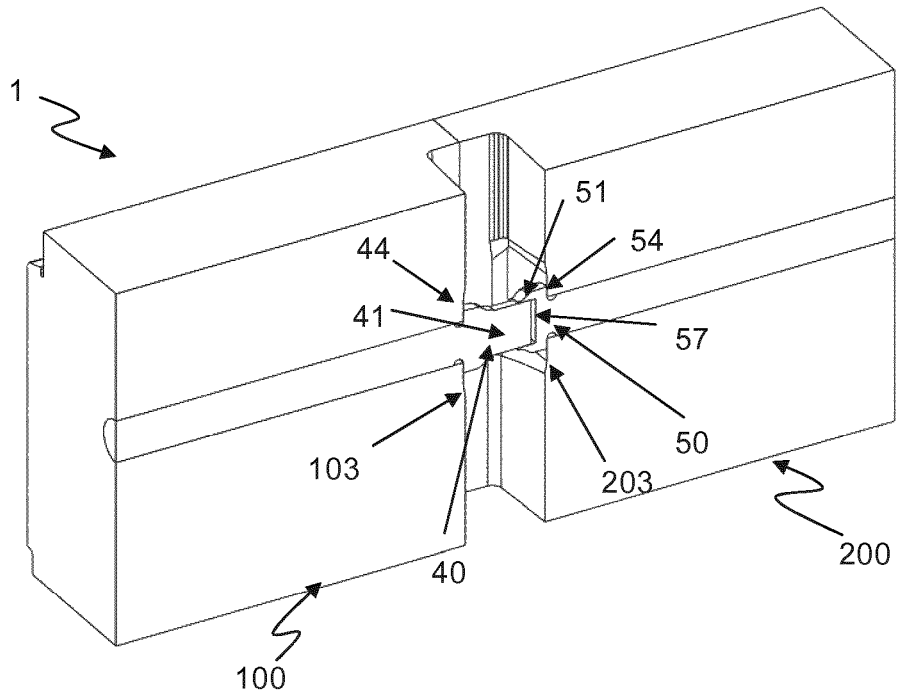

FIG. 5 shows an alternative of the press-tool 1 in which the first and the second core portions 40, 50 are of male/female configuration. The front portion 41 of the first core portion 40 is thereby configured to be received in a recess 57 in the front portion 51 of the second core portion 50. In comparison to the first exemplary embodiment, the use of male/female configured core portions omits the need of abutment between contact surfaces of the respective core portions to achieve a continuous core. Therefore male/female configuration of the core portions provides engagement between the core portions even at lower accuracy of the length dimension of the core portions. It is appreciated that, alternatively, the front portion 41 of the first core portion 40 may be of female configuration and the front portion 51 of the second core portion 50 may be of male configuration.

FIG. 5 also shows a further alternative of the press-tool 1 in which the first and the second core portions 40, 50 respectively comprise a shoulder 44, 54 which is configured to rest on the die cavity surface 103, 203 of the respective first and second die members 100, 200. The shoulder 44, 54 is advantageous since it prevents the core portions from pushing each other into the bore 105, 205 of the die cavity members 100, 200 when the ends of the core portions 40, 50 engage in the closed die cavity. It is appreciated that, alternatively, only one of the first and second core portions 40, 50 may comprise a shoulder.

Figure 6:
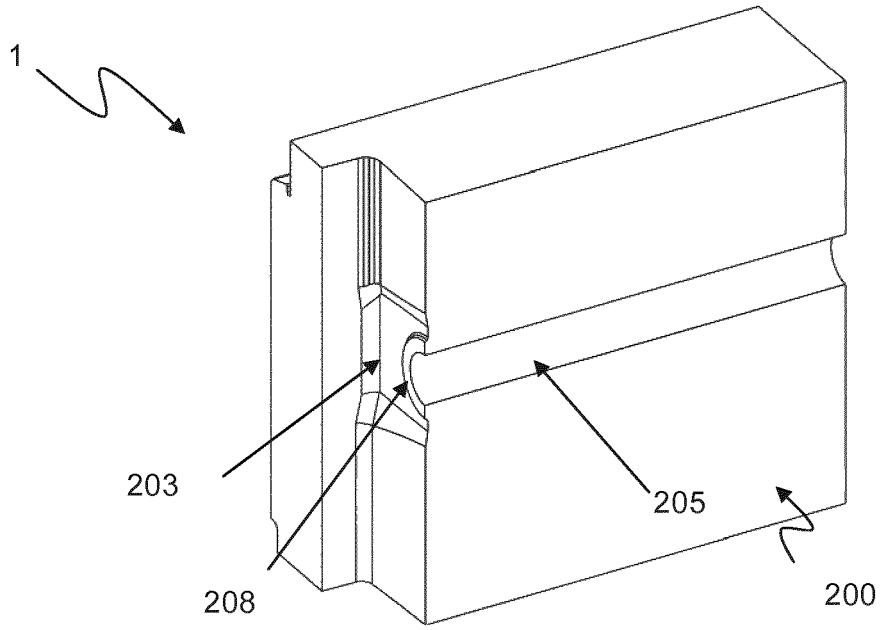

FIG. 6, shows a further alternative of the press-tool 1 in which the die cavity surface 203 of the second die member 200 comprises an annular resting surface 208 which surrounds the bore 205 and is configured to support the shoulder 54 of the core portion 50 shown in FIG. 5. Also, the die cavity surface 103 of the first die member 100 may comprise a resting surface 108 (not shown). The advantage of the resting surface 208 is that it constitutes a limited section of the die surface that may be machined to very high accuracy, for example, flatness in order to provide tight contact to the shoulder 54.

Figure 7:
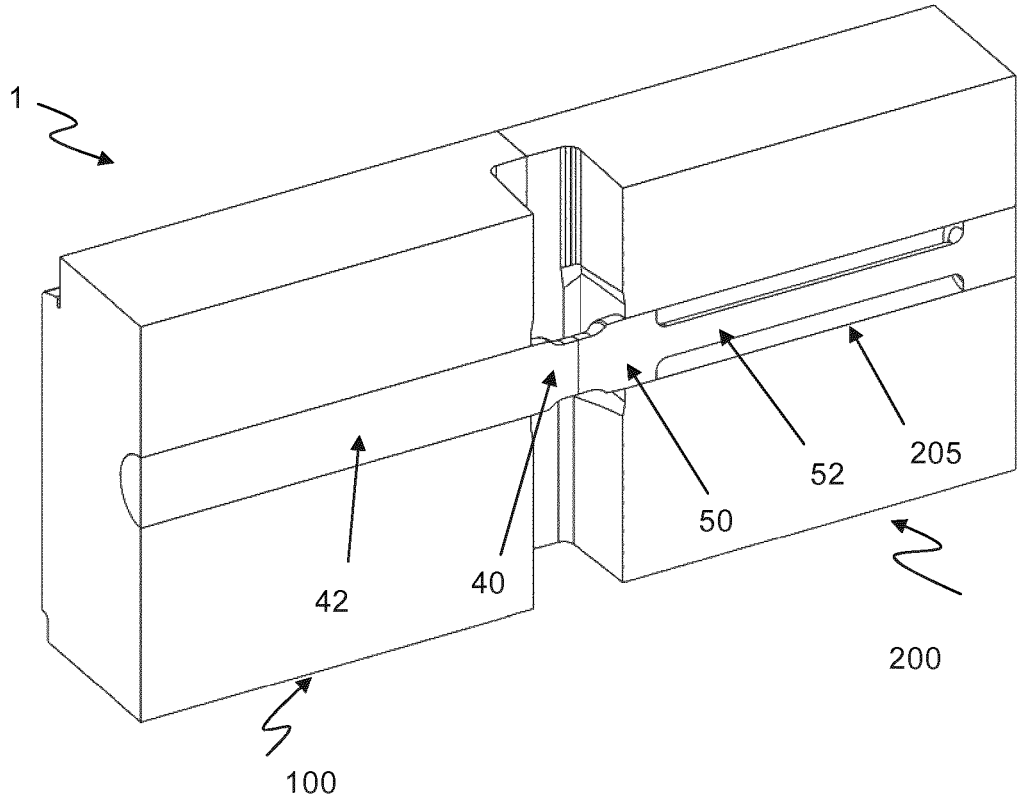

FIG. 7 illustrates an alternative in which the total compressional stiffness of one of the first or the second core portions 40, 50 is greater than the total compressional stiffness of the other of the first or the core portions 40, 50. The compressional stiffness of a body is a measure of the resistance offered by the body to elastic deformation. The total compressional stiffness may in the present disclosure be controlled by the material composition of the first and second core portions 40, 50. That is, for example, one of the core portions 40, 50 may be composed of a material of different stiffness than the material of the other of the first and the second pin 42, 52. The total compressional stiffness may also be controlled by the geometrical dimension of the first and the second core portion. For example, the pin 42, 52 of one of the first and the second core portions 40, 50 may have greater cross-sectional area than the pin 42, 52 of the other of the first and the second core portion. It is also possible to control the total compressional stiffness by a combination of material composition and geometric dimensions of the first and the first and the second core portion 40, 50.

In the embodiment shown in FIG. 7 the pins are of the same material, but the pin 52 of the second core portion 50 has smaller cross-sectional area than the pin 42 of the first core portion 40. The pin 52 of the second core portion 50 is therefore of lower compressional stiffness than the pin 42 of the first core portion 40. The difference in total compressional stiffness will result in that the second pin 52 will yield when the first and the second core portion 40, 50 engage in the die cavity 3. This in turn will result in that the pin 52, having lower total compressional stiffness, will act as a spring and flex under the force from the coarser pin 42 of the first core portion 40. The advantage of this configuration is that it compensates for dimensional inaccuracy of the axial extension of the first and the second core portion. That is, the difference in total compressional stiffness of the first and the second pin 42, 52 auto-compensates for excessive length of the core portions 40, 50. It is also possible to deliberately over-dimension the axial extension of the core portions and use the spring effect to ensure complete and tight contact between the first and the second core portions.

Figure 8:
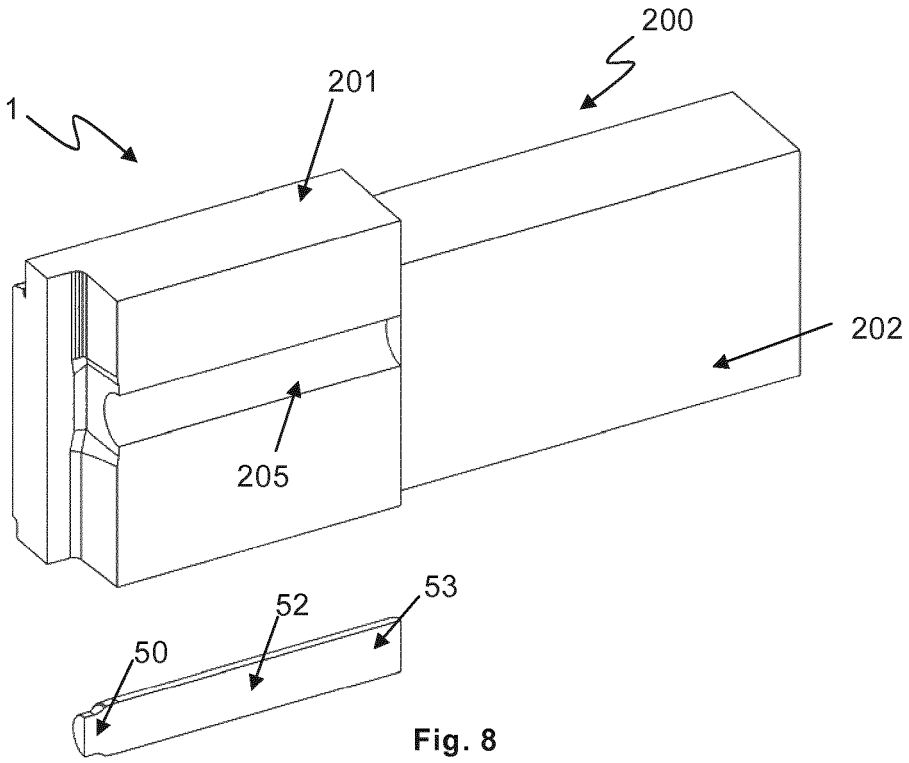

FIG. 8 is a partially exploded drawing and shows an alternative of the press-tool 1 in which the core portions 50 is configured to be releasable attached to the second die member 200 by application of an adhesive between at least a portion of the pin 52 of the core portion 50 and the bore 205 in the die member, 200. The adhesive (not shown) is typically applied onto at least a portion of the pin 52 prior to inserting the pin 52 into the bore 205. Alternatively the adhesive is applied in the bore 205 prior to inserting the pin 52 into the bore. The adhesive may be in the form of glue, for example Loctite 6300 or Loctite 3090. The adhesive may also be in the form of solder, for example Meltolit 449 MP or Meltolit WC 75. Both glue and solder are advantageous since these substances, in cold state, strongly attach the pin to the bore but soften when heated which makes it possible to remove the pin and core portion.

It is appreciated that the dimension of at least a portion of the pin 52 is selected such that there is sufficient space for applying the adhesive between the pin 52 and the bore 205. It is also appreciated that adhesive may be applied to the entire length of the pin 52, which results in strong bond between the pin 52 and the bore 205. Alternatively, adhesive is only applied to a portion of the pin 52. For example, the application of adhesive may be limited to the rear end 53 of the pin 52. It is then only necessary to heat a small section of the die member 200 to soften the adhesive in order to remove the pin.

Figure 9:
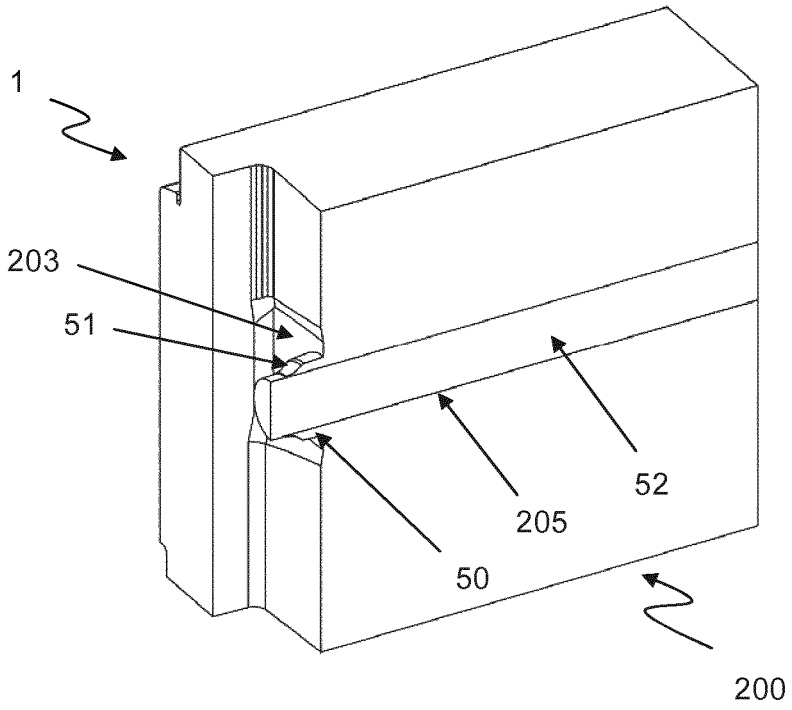

FIG. 9 shows an alternative of the press-tool 1 in which the second core portion 50 is integral with the second die member 200 as shown in FIG. 4. However, according to this alternative, the second die member 200 comprises a second bore 205, which extends through the second core portion 50. The press-tool 1 further comprises a second pin 52 which is separate from the second core portion 50 and extends through the second bore 205 such that an end of the second pin 52 extends out the front portion 51 of the second core portion 50. One advantage with this configuration is that there is no interface between the core portion 50 and the die cavity surface 203 while the pin 52 may flex in the bore 205. The lack of an interface between the core portion 50 and the die cavity surface 203 eliminates the possibility that powder enters between the core portion 50 and the die cavity surface 203 and forms a flash or a mark on the cutting insert green body. It is appreciated that also the first die member 100 may comprise a bore 105 extending though the first core portion 40 and a pin 42 arranged as described above (not shown).

It is appreciated that the first embodiment and the various alternatives may be combined into various combinations. For example, core portions formed integral with the die members as shown in FIG. 4 may be provided with male/female configuration as shown in FIG. 5. Or, the pins of FIG. 5 may be given the dimensions shown in FIG. 7. Or, the first die member 100 including the core portion 40 of the press-tool 1 in FIG. 7 may be replaced with the first die member 100 of FIG. 4, having an integral core portion 40.

In addition, the first and the second pins 42, 52 may have a non-circular cross-section and the first and second bores 105, 205 may have a corresponding non-circular cross-section (not shown). This ensures that the first and second core portions 40, 50 are prevented from rotating in the bore and that the core portions therefore are locked in proper alignment.

It is further appreciated that the first and second core portions in the respective first and second die member may be arranged concentrically. That is, the first and the second core portions 40, 50 are thereby aligned such that the ends of the first and second core portion face each other. This will result in an accurate through hole in the cutting insert green body.

Hereinabove, a first exemplary embodiment of the press-tool 1 according to the present disclosure has been described with reference to a press-tool 1 having a first and a second core portion 40, 50 which together form a core 6 through the die cavity 3. However, according to a second exemplary embodiment, the press-tool 1 may comprise at least one core portion 40, 50 arranged in the first or in the second die member 100, 200. The at least one core portion 40, 50 is configured to form a core 6 through the die cavity 3 when the first and the second die member 100, 200 are in the end position.

Figure 10A:
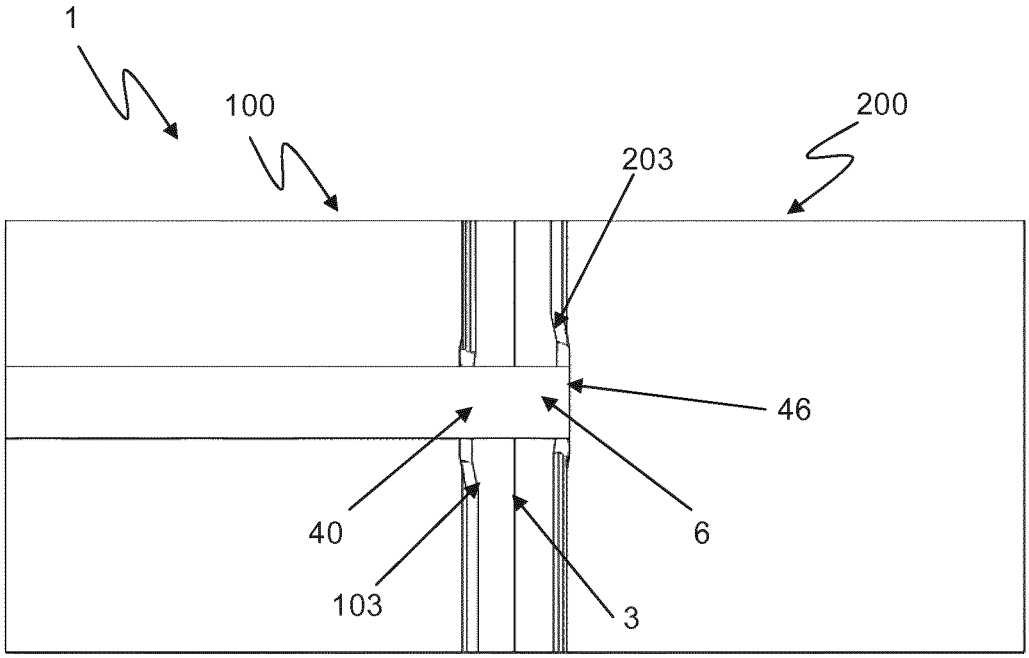
FIG. 10*a, b*: Schematic drawings of a press-tool according to a second exemplary embodiment of the disclosure.

FIG. 10*a* shows schematically a side view of a press-tool 1 according to a second exemplary embodiment of the present disclosure. It is appreciated that the press-tool 1 according to the second exemplary embodiment is identical to the press-tool described in the first exemplary embodiment and comprises all features thereof, with the only difference that the press-tool of second exemplary embodiment comprises one single core portion 40 instead of a first and a second core portion 40, 50.

Thus, in the press-tool 1 shown in FIG. 10*a* the first and the second die member 100, 200 are in the end position in which a die cavity 3 is formed between the first die member 100 and the second die member 200. The first and the second punches are not visible in FIG. 10*a*. A first core portion 40 is arranged in the first die member 100 and extends from the die cavity surface 103 of the first die member 100, through the die cavity 3, to the die cavity surface 203 of the second die member 200. The first core portion 40 thereby forms a core 6 through the die cavity 3. The contact surface 46 of the first core portion 40 may thereby be in engagement with die cavity surface 203 of the second die member 200 such that a continuous core 6 is formed through the die cavity 3. However, as described under the first exemplary embodiment, there may be a small play between the contact surface 46 of the first core portion 40 and the die cavity surface 203 of the second die member.

Figure 10B:
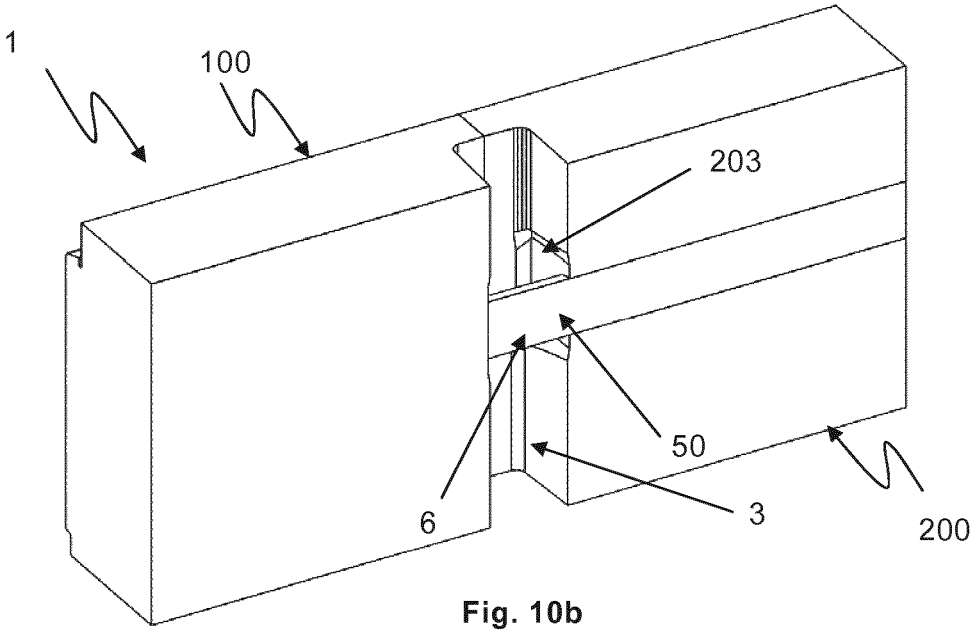
Figure 11:
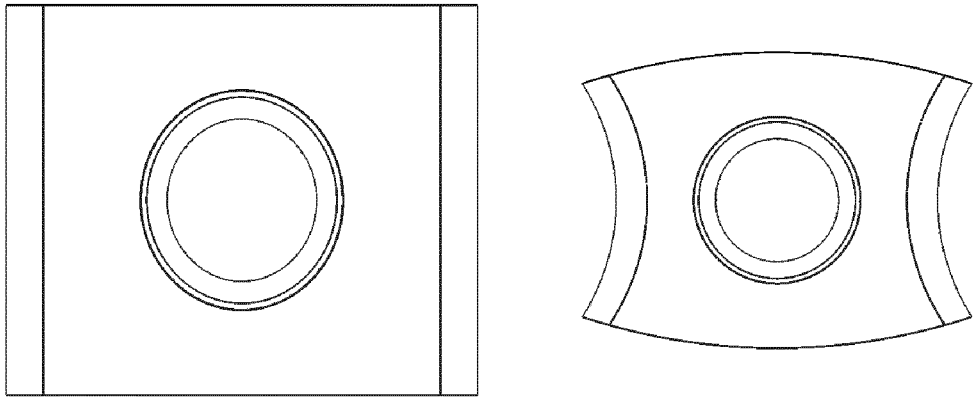
FIG. 11, 12: Schematic drawings of simplified depicted cross-hole inserts according to the prior-art having an initial green body shape (left) and final sintered shape (right)
Figure 12:
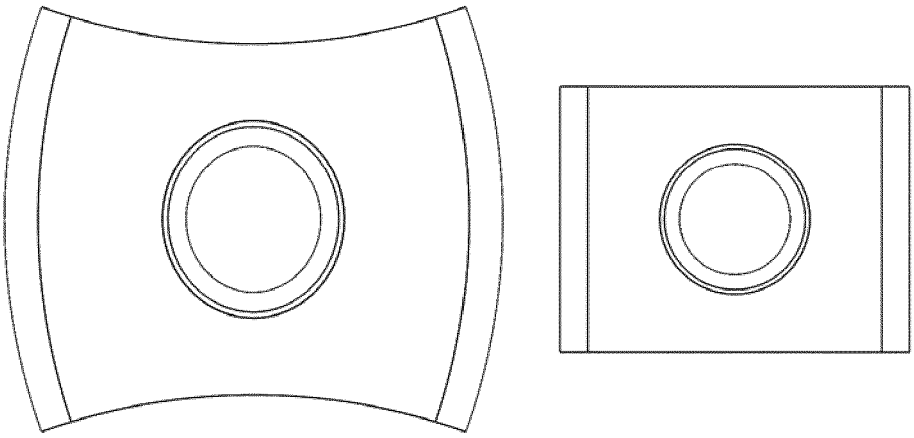

It is appreciated that the at least one core portion, alternatively, maybe be arranged in the second die member 200. FIG. 10*b* shows schematically a perspective view of the press-tool 1 according to the second exemplary embodiment of the disclosure. The one single core portion 50 is arranged in the second die member 200 and forms a core 6 which extends from the second die cavity surface 203, through the die cavity 3, to the first cavity surface 103 (not shown) of the first die member 100.

The invention claimed is:

1. A press-tool for manufacturing a cutting insert green body, comprising:

a first and a second punch arranged to move towards and away from each other along a first pressing axis;

a first and a second die member arranged to move towards and away from an end position along at least a second axis which is non-parallel to the first pressing axis, wherein the first die member includes a first die cavity surface and the second die member includes a second die cavity surface, the first and second die members being configured to form, in the end position, a die cavity having first and second openings for receiving the first and second punches;

a core extending between the first and the second die cavity surfaces, through the die cavity, when the first and the second die members are in the end position; and at least a first core portion for forming at least a portion of the core, the at least first core portion being arranged in the first or the second die member and joined to the first or the second die member, such that the at least first core portion is moved together with the first or the second die member to the end position.

2. The press-tool according to claim 1, wherein the at least first core portion is releasably attached to the first or the second die member.

3. The press-tool according to claim 1, wherein the at least first core portion is arranged in the first die member.

4. The press-tool according to claim 3, wherein the first die member includes a first bore extending from the first die cavity surface towards a rear end of the first die member and wherein the first core portion includes a first pin arranged in the first bore.

5. The press-tool according to claim 4, wherein at least a portion of the first pin is adhesively or mechanically joined to the bore in the first die member.

6. The press-tool according to claim 3, wherein the first die member includes a first recess and wherein the first core portion includes a first locking member configured to fit into the first recess of the first die member, whereby the locking member and the first recess are configured such that the first locking member is held in the first recess such that rotational and/or translational movement of the first core portion is restricted.

7. The press-tool according to claim 1, further comprising a second core portion for forming at least a portion of the core, wherein the second core portion is arranged in the second die member.

8. The press-tool according to claim 7, wherein the second die member includes a second bore extending from the second die cavity surface towards a rear end of the second die member and wherein the second core portion includes a second pin arranged in the second bore.

9. The press-tool according to claim 8, wherein at least a portion of the second pin is adhesively or mechanically joined to the second bore in the second die member.

10. The press-tool according to claim 7, wherein the second die member includes a second recess and wherein the second core portion includes a second locking member configured to fit into the recess of the second die member whereby the second locking member and the second recess are configured such that the second locking member is held in the second recess such that rotational and/or translational movement of the second core portion is restricted.

11. The press-tool according to claim 7, wherein the first core portion is arranged in, and joined to, the first die member and the second core portion is arranged in, and joined to, the second die member such that the first core portion is moved together with the first die member to the end position and the second core portion is moved together with the second die member to the end position and form the core through the die cavity.

12. The press-tool according to claim 7, wherein the first core portion includes a first front portion and the second core portion includes a second front portion, the first and second front portions being arranged to mutually engage each other to form a continuous core through the die cavity.

13. The press-tool according to claim 7, wherein a total compressional stiffness of one of the first or the second core portion is greater than a total compressional stiffness of the other of the first or the second core portion.

14. The press-tool according to claim 1, wherein the at least first core portion includes a shoulder which is configured to rest on the first or the second die cavity surface.

15. The press-tool according to claim 1, wherein the at least first core portion is integral with the first or the second die member.

16. The press-tool according to claim 15, wherein the first die member includes a first bore extending through the first core portion towards a rear end of the first die member, and a first pin is arranged in the first bore and extends through the first core portion.

17. The press-tool according to claim 6, wherein the first die member includes a first bore extending through the first core portion towards a rear end of the first die member, and a first pin is arranged in the first bore and extends through the first core portion.

* * * * *